United States Patent [19]

Lowthorp, deceased et al.

[11] 4,091,765

[45] May 30, 1978

[54] DEVELOPING AND FUSING APPARATUS

[75] Inventors: Ernest C. Lowthorp, deceased, late of Stone Mountain, Ga., by Vivian L. Lowthorp, executrix; Frances T. Arnold, Atlanta, Ga.; Luther R. Winters, Jr.; Roy Lippert, both of Orlando, Fla.

[73] Assignee: Vivian L. Lowthorp, Stone Mountain, Ga.

[21] Appl. No.: 769,441

[22] Filed: Feb. 17, 1977

[51] Int. Cl.[2] ..... G03G 15/09

[52] U.S. Cl. ..... 118/658; 118/261; 355/3 FU

[58] Field of Search ..... 118/644, 60, 658, 653, 118/657, 261; 355/3 FU; 100/176

[56] References Cited

U.S. PATENT DOCUMENTS

| | | | |
|---|---|---|---|
| B 493,501 | 2/1976 | Root | 355/3 FU |
| 3,145,122 | 8/1964 | Streich, Sr. | 118/658 |
| 3,387,586 | 6/1968 | Shelffo et al. | 118/658 |
| 3,559,620 | 2/1971 | Selb | 118/644 |
| 3,626,898 | 12/1971 | Gawron | 118/658 |
| 3,655,282 | 4/1972 | Turner et al. | 355/3 FU |
| 3,666,247 | 5/1972 | Bant | 355/3 FU |
| 3,796,183 | 3/1974 | Thettu | 355/3 FU |
| 3,822,139 | 7/1974 | Westdale | 118/658 X |
| 3,875,581 | 4/1975 | Yamashita et al. | 118/262 X |
| 3,931,793 | 1/1976 | Kolibas | 355/3 FU |
| 3,941,469 | 3/1976 | Okamoto | 118/657 X |
| 3,951,539 | 4/1976 | Draugelis | 118/653 |
| 4,014,291 | 3/1977 | Davis | 118/658 |

*Primary Examiner*—Mervin Stein
*Assistant Examiner*—Andrew M. Falik
*Attorney, Agent, or Firm*—B. J. Powell

[57] ABSTRACT

A developing and fusing apparatus for applying a single component magnetically responsive dry particulate toner powder to a latent electrostatic image on electrostatic copy paper and fusing the thusly applied toner powder onto the surface of the copy paper with the developing section of the apparatus having a permanent magnet applicator roll assembly which moves the toner powder about the periphery thereof into the vicinity of the copy paper to transfer the toner powder onto the copy paper with the amount of toner powder passing around the applicator roll assembly being controlled by doctor blades, and a cartridge which dispenses the toner powder onto the applicator roll assembly for passage around the applicator roll assembly. The fusing section of the apparatus includes a pair of fusing rolls which are urged toward each other with sufficient force to pressure fuse the toner powder onto the surface of the copy paper along with means for limiting the movement of the fuser rolls toward each other to prevent the fusing roll surfaces from actually contacing each other.

15 Claims, 11 Drawing Figures

DEVELOPING AND FUSING APPARATUS

BACKGROUND OF THE INVENTION

This invention relates generally to the developing of a latent electrostatic image on copy paper with a toner and the fusing of the toner onto the copy paper in an electrostatic copying machine and more particularly to the developing of the latent electrostatic image using a single component magnetic toner and the fusing of the toner onto the copy paper using pressure.

Since the inception of the single component magnetic toner powder for electrostatic copy machines, a number of devices have been proposed which apply the magnetic toner powder to the latent electrostatic image on electrostatic copy paper. Typical examples of such magnetic toner powder applicators are illustrated in U.S. Pat. Nos. 3,455,276; 3,739,749; and 3,849,161. One problem associated with the prior art magnetic toner applicators is the inability of these applicators to dispense the magnetic toner powder in the proper metered amount and at the proper flow rate to insure accurate and uniform distribution of the magnetic toner powder over the latent electrostatic image to develop same. Another problem associated with these prior art magnetic toner powder applicators is the difficulty encountered in replenishing the supply of magnetic toner powder in the applicator as required.

The magnetic toner powders are also capable of being fused onto the copy paper using pressure to rupture the magnetic toner powder particles and press them into the paper. Different devices have been proposed which use a pair of pressure rolls to apply pressure to the magnetic toner powder particles to rupture them and fuse them onto the paper. Examples of these arrangements are illustrated in U.S. Pat. Nos. 3,269,626; 3,295,497; and 3,846,151. One of the primary problems with these prior art pressure fusing devices is that the pressures required to rupture the magnetic toner powder particles to fuse the particles onto the copy paper causes these prior art fusing devices to produce an undesirable highly smooth finish on the copy paper which is thus highly reflective and therefore makes the copy paper more difficult to read. Another difficulty encountered with these prior art fusing devices is that the toner powder frequently sticks to one of the pressure fusing rolls as an incident to the fusing process to cause the image defined by the magnetic toner particles to offset onto one of the pressure fusing rolls. This has resulted in elaborate attempts to prevent the magnetic toner particles from offseting onto the pressure fusing rolls. Yet another problem associated with prior art pressure fusing devices is that the pressure rollers contacted each other when the copy paper was not between the rollers. This caused problems in feeding the paper between the rollers and also created undesirable noise when the rollers snapped back together after passage of the copy paper therethrough. Further, the metal-to-metal contact between the pressure rollers usually required a greater start-up torque than is available from the normal copy machine drive which necessitated a new separate drive motor for the pressure fusing device.

SUMMARY OF THE INVENTION

These and other problems and disadvantages associated with the prior art developing mechanisms using single component magnetic toner powder are overcome by the invention disclosed herein by providing a magnetic toner powder applicator which can properly meter the amount of the magnetic toner powder required to develop the latent electrostatic image on copy paper while at the same time insuring the proper toner powder flow rate for accurate and uniform distribution of the magnetic toner powder over the latent electrostatic image to develop same. Further, the invention is provided with a replacable magnetic toner powder cartridge assembly which greatly simplifies the replenishment of the supply of magnetic toner powder to the applicator. Further, the invention provides a pressure fusing device which fuses the magnetic toner powder particles onto the copy paper without producing an undesirable smooth finish on the copy paper and means as provided for insuring that the offset magnetic toner powder is removed from the pressure roll.

The invention includes a developer section with an applicator roll assembly that magnetically moves the magnetic toner powder around the periphery of the applicator roll assembly from a toning position in which the magnetic toner powder is supplied to the surface of the applicator roll assembly to a developing position where the magnetic toner powder is transferred from the applicator roll assembly onto the latent electrostatic image on the copy paper. A paper guide is provided at the developing position on the applicator roll assembly which guides the paper closely adjacent the periphery of the applicator roll assembly so that the magnetic toner powder on the periphery on the applicator roll assembly will be transferred to the latent electrostatic image on the copy paper. A primary doctor blade is mounted adjacent the developing position on the applicator roll assembly to accurately control the amount of toner powder moving around the applicator roll assembly at the developing position and a secondary doctor blade which is positioned above the primary doctor blade at the toning position so that a quantity of the toner powder is maintained between the secondary doctor blade and the applicator roll assembly to be accurately dispensed around the applicator roll assembly by the secondary doctor blade. A toner cartridge assembly is positioned above the secondary doctor blade and the applicator roll assembly which maintains the quantity of toner powder between the applicator roll assembly and the secondary doctor blade. The cartridge assembly is disposable and is replaced each time the supply of toner powder needs to be replenished.

The apparatus of the invention also includes a fusing section which includes a pair of pressure rolls between which the copy paper with the developed latent electrostatic image thereon passes so that the pressure exerted on the toner powder by the pressure rolls ruptures the magnetic toner powder and fuses it onto the paper to fix the developed latent electrostatic image on the copy paper. The surfaces of the pressure rolls are sufficiently rough to prevent the formation of a highly polished surface on the copy paper passing between the pressure rolls and an appropriate cleaning mechanism as provided for cleaning any offset toner powder from the surface of the pressure rolls. A pair of resilient members connect the pressure rolls so that they are loaded toward each other but not in direct contact to facilitate feeding of the copy paper through the rolls and prevent the roll surfaces from striking. Because the contact pressure between the pressure rolls is not carried through a metal-to-metal contact, the required start-up torque is sufficiently low to permit the existing copy machine drive to be used to drive the pressure rollers.

These and other features and advantages of the invention disclosed herein become more clearly understood upon consideration of the following specification and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 2:
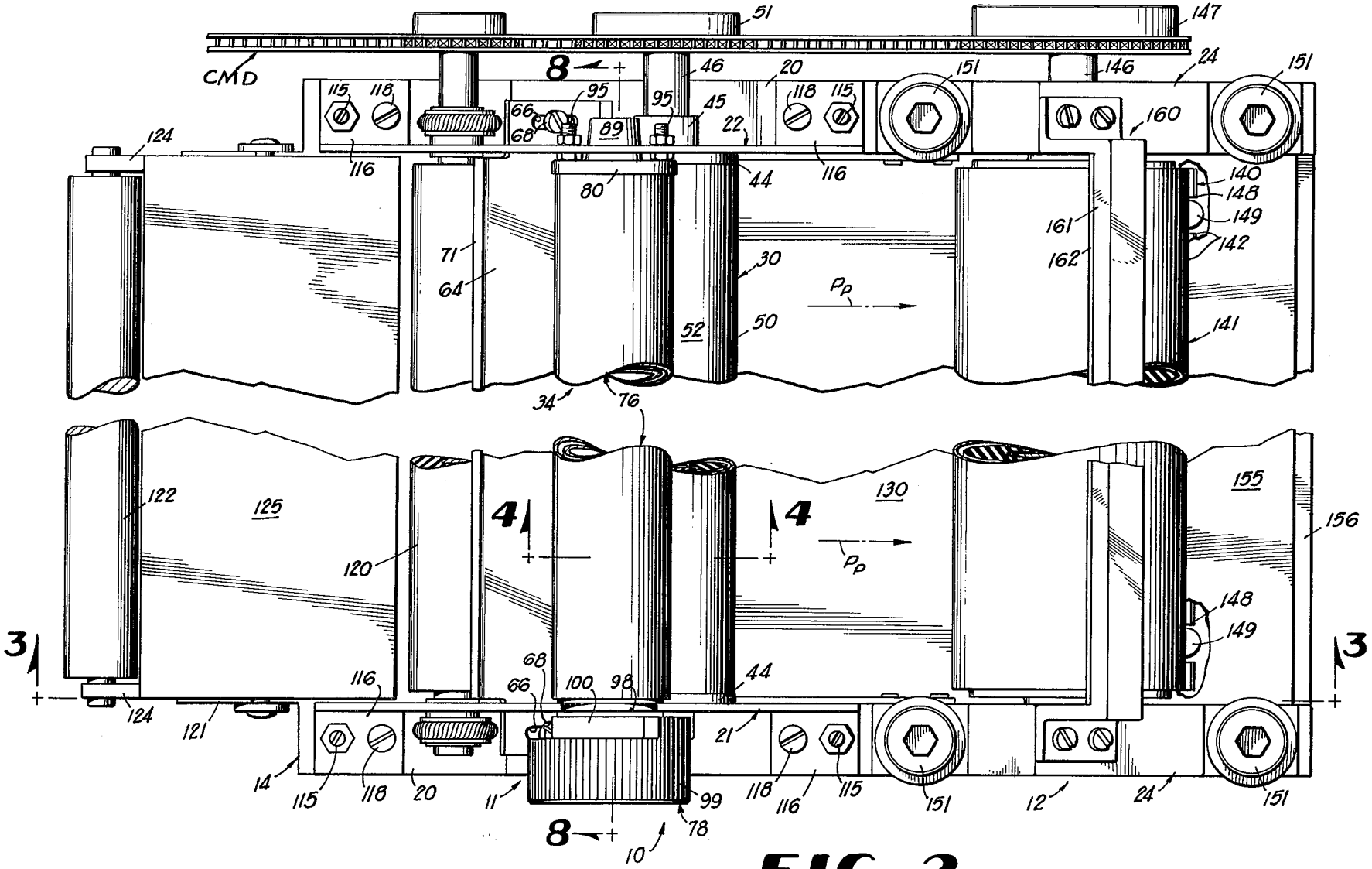
FIG. 2 is a top plan view of the invention of FIG. 1.
Figures 4, 5:
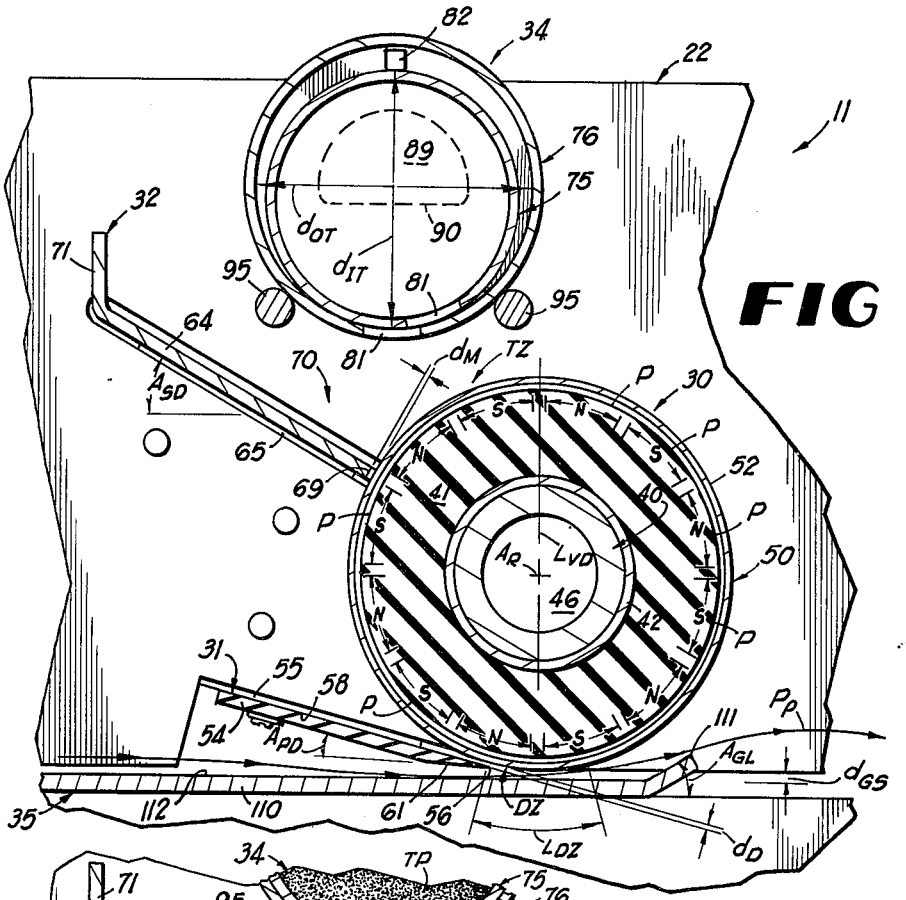
FIG. 4 is an enlarged cross-sectional view of a portion of the developing section of the invention taken generally along line 4—4 in FIG. 2.
FIG. 5 is a view similar to FIG. 4 showing the developing section in operation.

Referring to the figures, it will be seen that the invention includes a developing and fusing device 10 with a developing section 11 and a fusing section 12. The developing and fusing device 10 is designed to receive electrostatic copy paper on which has been formed a latent electrostatic image as is well known in the electrostatic copy machine art. The copy paper CP as seen in FIG. 5 with the latent electrostatic image indicated generally by the reference LEI on the top thereof passes first through the developing section 11 where a single component magnetically responsive dry particulate toner powder TP is applied to the latent electrostatic image LEI to develop same whereupon the copy paper with the developed latent electrostatic image passes through the fusing section 12 to fuse the toner powder TP onto the copy paper CP and fix the developed image onto the copy paper. It will be noted that the copy paper CP travels generally along a prescribed paper path $P_P$ as seen in FIGS. 2 and 4 whereas the developing section 11 and the fusing section 12 are arranged generally normal to the paper path $P_P$. The developing section 11 and fusing section 12 are mounted in a support frame 14 which mounts the device 10 in an electrostatic type copy machine (not shown).

Figure 1:
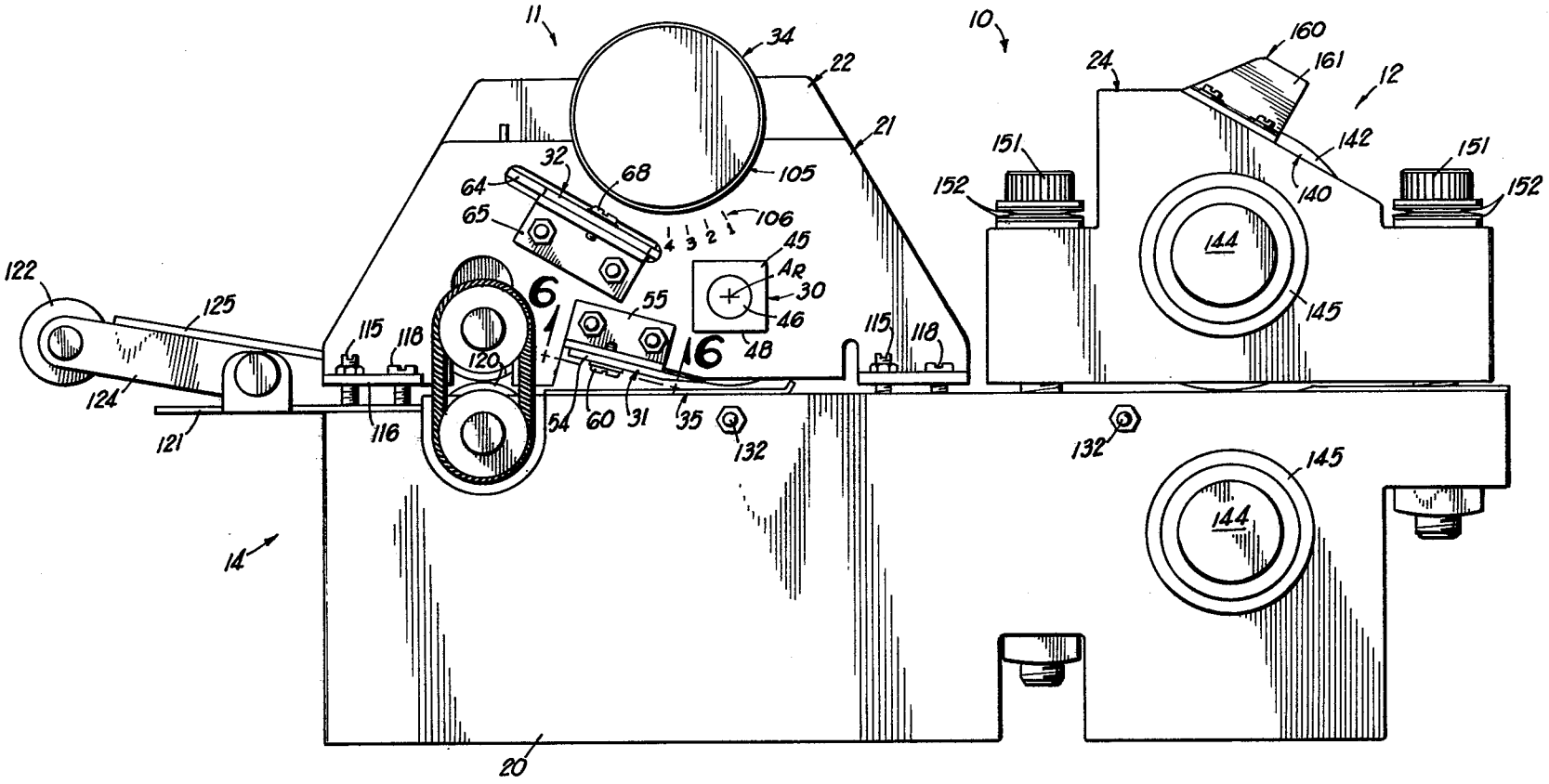
FIG. 1 is a side elevational view of an embodiment of the invention.
Figure 3:
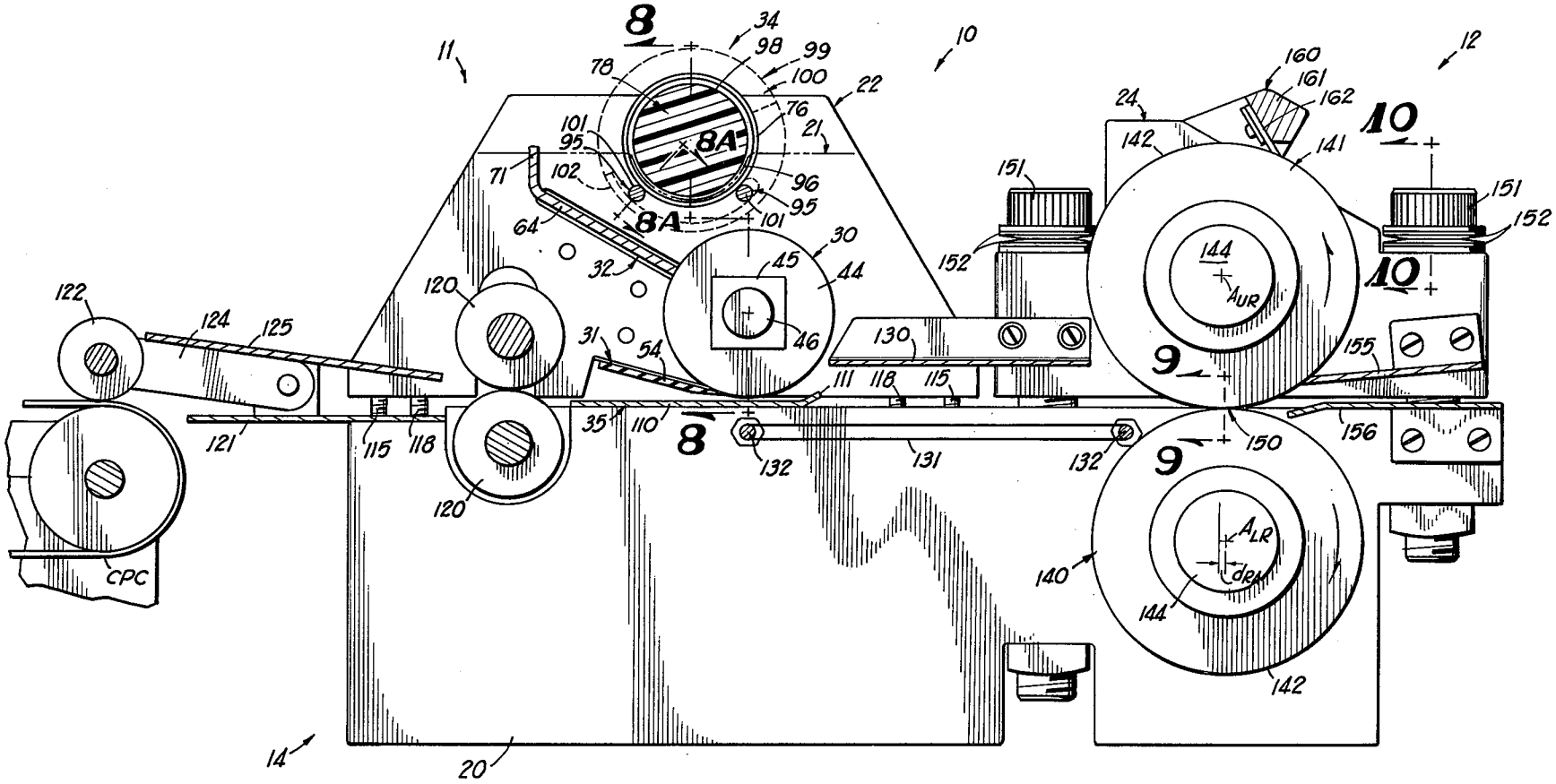
FIG. 3 is a longitudinal cross-sectional view taken generally along the line 3—3 in FIG. 2.

Referring to FIGS. 1-3, it will be seen that the support frame 14 includes a pair of spaced apart base side rails 20 which mount both the developing section 11 and the fusing section 12 therebetween. The base side rails 20 each mount a pair of developer side plates 21 and 22 thereon which carry the developing section 11 therebetween. A pair of fuser pillar blocks 24 are also mounted on the base side rails 20 to mount the fusing section 12 therebetween.

Referring to FIGS. 1-5, it will be seen that the developing section 11 includes generally an applicator roll assembly 30 which is mounted between the developer side plates 21 and 22 so that its roll axis $A_R$ is generally normal to the paper path $P_P$. A primary doctor plate assembly 31 is provided adjacent the bottom of the applicator roll assembly 30 to control the amount of toner powder passing around the applicator roll assembly. A secondary doctor plate assembly 32 is provided adjacent the top of the applicator roll assembly 30 for maintaining a supply of toner powder between the applicator roll assembly 30 and the secondary doctor plate assembly 32 and dispense same to the primary doctor plate assembly 31 as seen in FIG. 5. A toner cartridge assembly 34 is removably carried between the developer side plates 21 and 22 to supply the toner powder to the secondary doctor blade assembly 32 to be dispensed thereby. A guide assembly 35 is provided under the applicator roll assembly 30 to direct the copy paper CP closely adjacent the applicator roll assembly 30 so that the toner powder carried by the applicator roll assembly will be transferred to the latent electrostatic image on the copy paper CP as it passes thereby.

Figure 8A:
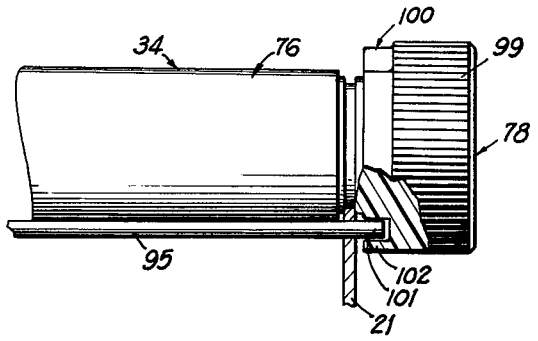
FIG. 8A is a partial cross-sectional view taken along line 8A—8A in FIG. 3.
Figure 8:
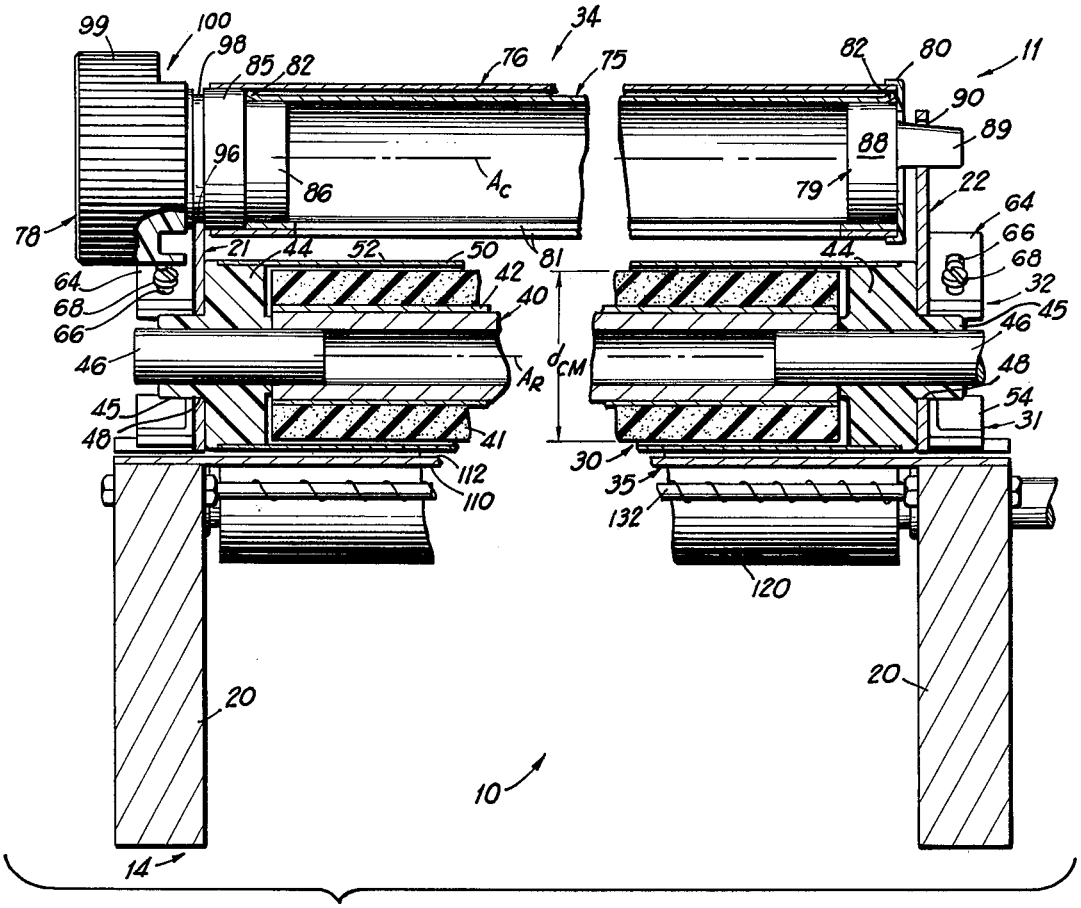
FIG. 8 is a longitudinal cross-sectional view of the cartridge assembly taken generally along line 8—8 in FIGS. 2 and 3.

The applicator roll assembly 30 as seen in FIG. 8 includes a support arbor 40 concentric about the roll axis $A_R$ which is preferably made of a non-permeable material such as aluminum and which fixedly mounts thereon a permanent magnet core member 41 also concentric about the roll axis $A_R$. The core member 41 has an outside diameter $d_{CM}$ and has circumferentially spaced magnetic poles P therein (FIG. 4) of alternating magnetic polarity which extend along the length of the core member 41 parallel to axis $A_R$. The core member 41 may be provided with a magnetic backing member 42 to enhance the magnetic strength on the outside of core member 41. The support arbor 40 is rotatably journalled through its stub shafts 46 in bearing blocks 44 just outboard of each end of core member 41 as seen in FIG. 8. Each of the bearing blocks 44 has a non-circular abuttment 45 on the outboard side thereof (FIGS. 1 and 3) which slidably fits in complimentary openings 48 through developer side plates 21 and 22 so that the developer side plates support the applicator roll assembly 30 these abuttments 45 with the roll axis $A_R$ generally perpendicular to the paper path $P_P$ and parallel to the plane of the copy paper as it moves along the paper path. A cylindrical sleeve member 50 is mounted between the bearing blocks 44 around the permanent magnet core member 41 so that the sleeve member 50 through the abuttments 45 on bearing blocks 44 is stationary relative to the developer side plates 21 and 22 while the core member 41 can freely rotate in the sleeve member 50. The sleeve member 50 is made out of a non-magnetic material such as aluminum so that the magnetic field generated by the core member 41 rotates therewith about sleeve member 50 to move the toner powder around the peripheral surface 52 of the sleeve member as will become more apparent. One of the stub shafts 46 on the support arbor 40 (FIG. 2) is provided with a drive member 51 connected to the drive CMD of the copy machine (not shown) to rotate the core member 41.

Figure 6:
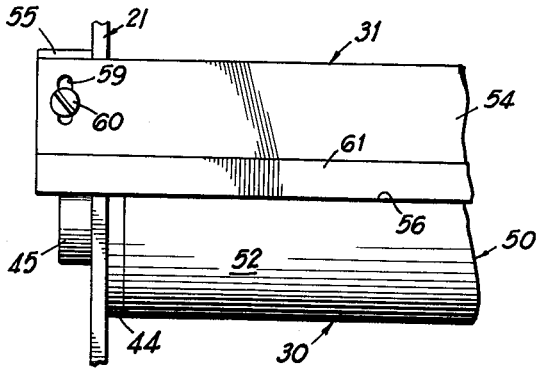
FIG. 6 is a partial view taken along line 6—6 in FIG. 1 showing the adjustment of the primary doctor blade.

The primary doctor blade assembly 31 is best seen in FIGS. 1 and 3-6 and includes a generally rectilinear doctor blade 54 which is adjustably mounted between the developer side plates 21 and 22 by a pair of brackets 55 (FIG. 1). The doctor blade 54 defines a primary doctor edge 56 (FIG. 4) along the projecting side thereof oriented generally parallel to the applicator roll axis $A_R$ and closely adjacent the peripheral surface 52 of sleeve member 50. The primary doctor blade 54 is oriented generally tangential to that point on the sleeve surface 52 at the primary doctor edge 56. This causes the space between the upper surface 58 of the primary doctor blade 54 and the peripheral surface 52 on sleeve 50 to decrease from the distal edge of blade 54 to the doctor edge 56. As the toner powder TP moves around the peripheral surface 52 counterclockwise as seen in FIG. 5, the upper surface 58 of blade 54 and the doctor edge 56 serve to accurately adjust the height of the toner powder layer TPL moving thereby. The doctor edge 56 on blade 54 is located at the upstream edge of the developing zone DZ on the peripheral surface 52 of sleeve member 50. The developing zone DZ must have a sufficient length to provide good transfer to the toner powder TP from the toner powder layer moving around the sleeve member 50 onto the latent electrostatic image on the copy paper CP. It has been found that a developing zone length $L_{DZ}$ (FIG. 4) of about 0.3 inch (7.62 mm) provides good transfer of the toner powder TP. For the particular size of sleeve member 50 illustrated, the length $L_{DZ}$ comprises about 30° on the periphery of the sleeve member 50. The minimum doctor distance $d_D$ (FIG. 4) between the blade 54 and the peripheral surface 52 of sleeve member 50 determines the amount of toner powder TP transferred to the copy paper CP in the developing zone DZ. If the doctor distance $d_D$ is too small, an insufficient amount of toner powder TP will pass the doctor edge 56 into the developing zone DZ to fully develop the latent electrostatic image LEI on the copy paper CP. On the other hand, if the doctor distance $d_D$ is too large, an oversupply of toner powder TP will pass the doctor edge 56 into the developing zone DZ to overdevelop the latent electrostatic image LEI on the copy paper CP. A distance $d_D$ of about 0.010–0.030 inch (0.25–0.76 mm) has been found to provide an adequate supply of toner powder TP to the developing zone DZ with a preferred setting of about 0.020 inch (0.51 mm). Adjustment of the primary doctor blade 54 is provided by elongate slots 59 in opposite ends of blade 54 with screws 60 that connect the blade 54 to brackets 55 as seen in FIG. 6. The lower inboard side of the primary doctor blade 54 is chamferred as seen in FIGS. 4–6 to provide a paper guide surface 61 that angles slightly toward the paper path $P_p$ as will become more apparent. While the developing zone DZ may be located at any position about the periphery of the applicator roll assembly 30, it is illustrated as centered on the vertical diametrical line $L_{VD}$ as seen in FIG. 4 on the lowermost point on the peripheral surface 52 of the sleeve member 50. This causes the primary doctor blade 54 to define an included angle $A_{PD}$ with respect to the horizontal at about 15° in FIG. 4.

The primary doctor blade 54 is made out of an electrically non-conductive material such as phenolic material. This prevents the discharge of the latent electrostatic image LEI on the copy paper CP that may come in contact with blade 54 as the copy paper CP passes thereunder toward the developing zone DZ.

As is generally known for permanent magnetic applicator rolls, the magnetic field from the poles P penetrates the sleeve member 50 to form a magnetic filed about the sleeve surface 52. This magnetic field has both field components and tangential field components with both of these components varying in strength across each pole P. The radial field component of each pole P is the greatest at the center of the pole whereas the tangential field component is greatest along opposite edges of the poles. The toner particles TP align themselves along the lines of force in the magnetic field and thus form particle columns or "trees" which orient themselves along these lines of magnetic force. Thus, these toner powder "trees" tend to stand up radially when the radial field component of the magnetic force field is the greater and tend to lay down against the sleeve surface 52 when the tangential field component is greater. As is also generally known, when the magnetic field produced by the core member 41 is rotated about the sleeve member 50, here illustrated as accomplished by rotating the core member 41, the toner powder "trees" walk around the peripheral surface 52 of the sleeve member 50. The movement of the toner powder TP about the sleeve member 52 is opposite in direction to the direction of the rotating magnetic field penetrating the sleeve member 50. Thus, the toner powder TP moves counterclockwise as illustrated in FIG. 5 while the core member 41 is rotated clockwise in FIG. 5. The toner powder layer TPL thus undulates in thickness about the sleeve member 50 in response to whether the radial field component or the tangential field component of the magnetic field is the stronger.

The strength of the magnetic field penetrating the sleeve member 50 determines the amount of toner powder TP that can be maintained in the toner powder layer TPL without falling therefrom under the influence of gravity on the toner powder TP as it moves around the sleeve member 50. The secondary doctor blade assembly 32 serves to accurately regulate the quantity of toner powder TP that is dispensed past the doctor edge 69 of the secondary doctor blade 64 as seen in FIG. 5 and the settings indicated earlier provide a dispensing rate for the toner powder TP in the reservoir 70 such that the toner power TP in the toner powder layer TPL will not easily fall from the surface 52 of the sleeve member 50 as the toner powder TP moves around the sleeve member 50 in the toner powder layer TPL. The greatest effective thickness of the toner powder layer TPL occurs when the toner powder TP is in that area where the radial field component is the greatest and tends to reach a maximum thickness $t_{MX}$ as seen in FIG. 5 when the thickness of the toner powder layer TPL is not mechanically adjusted. Also, when the maximum thickness of the toner powder layer TPL is mechanically adjusted to a thinner thickness, the toner powder layer TPL will tend to recover back toward this maximum thickness $t_{MX}$. Therefore, it is exceedingly important that the thickness of the toner powder layer TPL be mechanically adjusted as close to the developing zone DZ as is physically possible in order to achieve the proper and accurate transfer of the toner powder TP from the toner powder layer TPL onto the latent electrostatic image LEI on the copy paper CP. The developer section 11 disclosed herein achieves this feature by providing the doctor edge 56 on the primary doctor blade 54 at the upstream edge of the developing zone DZ as seen in FIG. 5. Thus, the thickness of the toner powder layer TPL at the maximum radial field component in the magnetic field as it passes through the developing zone DZ is accurately controlled since the thickness of the toner powder layer TPL does not have sufficient time to recover back toward its maximum thickness $t_{MX}$ before the tone powder TP in the toner powder layer TPL has passed through the developing zone DZ.

The secondary doctor blade assembly 32 is best seen in FIGS. 1–5 and includes a generally rectilinear doctor blade 64 which is adjustably mounted between developer side plates 21 and 22 on a pair of secondary brackets 65 (FIG. 1). Each end of blade 64 protruding through side plates 21 and 22 is slotted at 66 (FIG. 2) and screws 68 adjustably connect the blade 64 to brackets 65 through the slots 66. The secondary doctor blade 64 is oriented generally radially with respect to the applicator roll assembly 30 and defines a secondary doctor edge 69 (FIG. 4) along the inboard edge thereof facing the peripheral surface 52 on sleeve member 50. The secondary doctor edge 69 is also oriented generally parallel to the applicator roll axis $A_R$ and closely adjacent the peripheral surface 52 on the sleeve member 50. The secondary doctor blade 64 is circumferentially shifted upstream of the primary doctor blade 54 (clockwise in FIGS. 4 and 5) so that the secondary doctor blade 64 angles downwardly toward the applicator roll assembly 30 at an angle $A_{SD}$ with respect to the horizontal to define a metering reservoir 70 between the top of blade 64 and the sleeve member 50. While angle $A_{SD}$ may be conveniently changed, the angle $A_{SD}$ illustrated in FIGS. 4 and 5 is about 30°. Thus, a toning zone TZ is defined at sleeve surface 52 where the toner powder TP is applied to sleeve member 50 as it passes therethrough. The outboard edge of the secondary doctor blade 64 is provided with an upstanding retaining lip 71 to assist in maintaining the toner powder TP in the metering reservoir 70.

The rate at which the toner powder TP in reservoir 70 is metered therefrom to pass around the sleeve member 50 toward the primary doctor blade 54 in the toner powder layer TPL is controlled by the secondary doctor blade 64 through the doctor edge 69. This is determined by the meter distance $d_M$ (FIG. 4) between the secondary doctor edge 69 and the peripheral surface 52 on the sleeve member 50. A distance $d_M$ of about 0.015–0.040 inch (0.38–1.02 mm) has been found to adequately provide a metering rate for the toner powder layer TPL to be maintained with a preferred setting of about 0.020 inch (0.51 mm).

Figure 7:
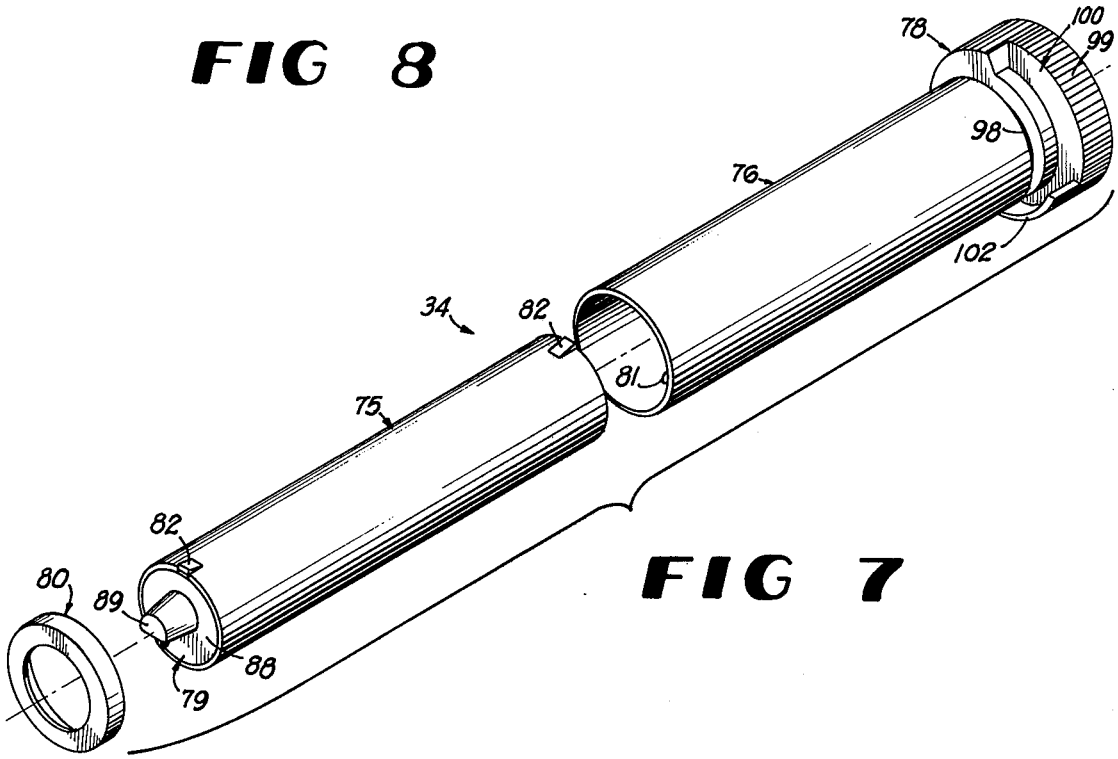
FIG. 7 is an exploded perspective view of the cartridge assembly.

The toner cartridge assembly 34 is best seen in FIGS. 2–5, 7 and 8, and serves to dispense toner powder TP into the reservoir 70 above the secondary doctor blade assembly 32. The cartridge assembly 34 is disposable and is replaced with a new cartridge each time the toner powder TP carried therein is consumed. As best seen in FIGS. 7 and 8, the toner cartridge assembly 34 includes an inner tube 75 rotatably carried in an outer tube 76. The outer tube 76 is positioned by a control knob 78 while the inner tube 75 is positioned by a locking member 79. The inner tube 75 is axially maintained in the outer tube 76 by a retaining ring 80. Both the inner tube 75 and outer tube 76 are made out of an inexpensive material such as cardboard and each is provided with an elongate dispensing slot 81 extending parallel to the cartridge axis $A_C$ so that the slots 81 can be placed in registration with each other as the tube 76 is rotated about the inner tube 75 as seen in FIGS. 4 and 5. The slots 81 extend along almost all of the length of the tubes 75 and 76. The outer tube 76 has an inside diameter $d_{OT}$ (FIG. 4) which is slightly greater than the outside diameter $d_{IT}$ (FIG. 4) of the inner tube 75 to provide sufficient clearance for the tubes 75 and 76 to be rotated with respect to each other. To maintain a toner tight seal between the slot 81 in the inner tube 75 and the inside of the outer tube 76, a pair of locating tangs 82 (FIGS, 4, 7 and 8) are provided on opposite ends of inner tube 75 diametrically opposite slot 81 in the tube 75.

The front end of the outer tube 76 is mounted on a circulate shank 85 (FIG. 8) on the control knob 78 to close same. The front end of the inner tube 75 is closed by a cylindrical plug 86 while the rear end of inner tube 75 is closed by a cylindrical section 88 on locking member 79. To prevent the inner tube 75 from turning when it is in position in the developing section 11 as seen in FIG. 8, a tapered, rearwardly extending locking projection 89 is provided on locking member 79 that has a generally semicircular cross-section. The projection 89 is received through a complimentarily shaped semi-circular opening 90 through the rear developer side plate 22 (FIGS. 4 and 8) when the cartridge assembly 34 is in operative position. The opening 90 is oriented in side plate 22 and the projection 89 is located with respect to slot 81 in inner tube 75 so that the slot 81 opens downwardly in the lowermost point of tube 75 as seen in FIG. 4. The retaining ring 80 is mounted on the rear end of the outer tube 76 and captivates the inner tube 75 within tube 76 between the shank 85 on control knob 78 and retaining ring 80 as seen in FIG. 8.

To position the cartridge assembly 34 as it is being positioned in the developer section 11, a pair of spaced apart support rods 95 are provided which extend between developer side plates 21 and 22 (FIGS. 3–5) equally spaced from opening 90 in rear side plate 22 and parallel to the applicator roll axis $A_R$. The opening 90 and support rods 95 are centered over the secondary doctor edge 69 on the upper doctor blade 64. Thus, as the rear end of cartridge assembly 34 is supported on and slipped along the support rods 95, the projection 89 is located in registration with opening 90 in rear side plate 22.

To support the front end of the cartridge assembly 34, the front developer side plate 21 is provided with a semi-circular cutout 96 which is engaged by the control knob 78. The cutout 96 is best seen in FIG. 3 by phantom lines. It will be noted that the front developer side plate 21 is shorter than the rear developer side plate 22 so that the cartridge assembly 34 will easily fit in the cutout 96. The control knob 78 is provided with an annular recess 98 just forwardly of the circular shank 85 thereon which is sized to fit within the semi-circular cutout 96 in the front developer side plate 21 so that the control knob 78 is rotatably supported therein yet the sides of the recess 98 axially fix the cartridge assembly 34 with respect to side plates 21 and 22 when the cutout 96 is received in the recess 98. The control knob 78 is provided with a manually grippable section 99 forwardly of the recess 98 so that the control knob 78 can be manually grasped to rotate the outer tube 76 while the inner tube 75 is held fixed by the locking projection 89 on the locking member 79.

The rear end of the manually grippable section 99 is provided with an accurate cutout 100 which is designed to receive the forwardly projecting ends 101 of the support rods 95 therein as best seen in FIG. 8A where the forwardly projecting ends 101 of the support rod 95 project forwardly of the front developer side plate 21. An arcuate retaining flange 102 is provided on the rear of the manually grippable section 99 of the control knob 78 and projects over a portion of the arcuate cutout 100 as best seen in FIGS. 7 and 8A so that the retaining flange 102 which is shorter in length than the arcuate cutout 100 can be rotated under the forwardly projecting ends 101 on the support rods 95 to hold the cartridge assembly 34 in position in the developer section 11. That portion of the arcuate cutout 100 which is not provided with the retaining flange 102 is located so that when the elongate slot 81 in the outer tube 78 is rotated out of registration with the slot 81 in the inner tube 75, the cartridge assembly 34 can be lowered onto the dront developer side plate 21 so that the recess 98 in the control knob 78 fits in the cutout 96 in the front developer side plate 21 and the forwardly projecting ends 101 of the support rods 95 lie within that portion of the arcuate cutout 100 which is not provided with the retaining flange 102. As the manually grippable section 99 is rotated to rotate the elongate slot 81 in the outer tube 76 into registration with the elongate slot 81 in the inner tube 75, the retaining flange 102 is rotated under the forwardly projecting ends 101 of the support rods 95 to hold the cartridge assembly 34 in the position seen in FIGS. 2 and 8.

The manually grippable section 99 is rotated until the slots 81 come into registration to allow the toner powder TP in the inner tube 75 to be dispensed into the reservoir 70 above the secondary doctor blade 64 as seen in FIG. 5. The spacing of the cartridge assembly 34 above the secondary doctor blade 64 can be such that the level of the toner power TP in the reservoir 70 above the secondary doctor blade 64 closes the slot 81 in the outer tube 76 to limit the flow of the toner powder TP therefrom or the manually grippable section 99 may be rotated to bring the slots 81 into registration to dispense a certain amount of toner powder TP and then rotated back out of registration until the toner powder TP in the reservoir 70 above the secondary doctor blade 64 is consumed. To provide an indication of the amount of registration between the slots 81, a pointer 105 may be provided on the manually grippable section 99 as seen in FIG. 1 with appropriate indicia 106 provided on the front developer side plate 21 as seen in FIG. 1 quantify the setting of the slots 81.

The guide assembly 35 is best seen in FIGS. 1–5 and includes a generally flat rectilinear guide plate 110 which is carried between the base side rails 20 under the applicator roll assembly 30. The downstream end of the guide plate 110 is provided with an upturned guide lip 111 that serves to deflect the copy paper CP upwardly thereover as best seen in FIG. 5. The guide lip 111 is located a distance $d_{GL}$ (FIG. 5) downstream of the vertical line $L_{VD}$ through the roll axis $A_R$ (shown as about 3/16 inch, 5.08 mm) and serves to deflect the copy paper CP downwardly to wrap the copy paper CP closely adjacent the peripheral surface 52 of the applicator roll assembly 30 in the developing zone DZ again as best seen in FIG. 5. The upper guide surface 112 of the guide plate 110 is located a prescribed distance $d_{GS}$ below the closest point to the guide surface 112 and the peripheral surface 52 on the sleeve member 50 of the applicator roll assembly 30 as best seen in FIG. 4. The guide lip 111 angles upwardly at an angle $A_{GL}$ with the horizontal as best seen in FIG. 4 and is illustrated at 30°. Thus, it will be seen that the upper guide surface 112 guides the copy paper CP under the applicator roll assembly 30 and then deflects the copy paper CP up around the applicator roll assembly 30 to generate a sufficient wrap of the copy apper CO around the applicator roll assembly 30 in the developing zone DZ to affect good transfer of the toner powder TP from the applicator roll assembly 30 onto the electrostatic image on the copy paper CP. The distance $d_{GS}$ of the upper guide surface 112 below the peripheral surface 52 on the applicator roll assembly 30 is such that the copy paper CP is sufficiently close to the applicator roll assembly 30 to affect transfer of the toner powder TP from the peripheral surface 52 on the applicator roll assembly 30 to the latent electrostatic image LEI on the copy paper CP. The distance $d_{GS}$ is about 0.020–0.060 inch (0.51–1.52 mm) with a preferred setting of about 0.048 inch (1.22 mm).

The copy paper CP is fed through the developer section 11 by a set of driven feed rolls 120 (FIGS. 1 and 3) oriented generally normal to the paper path $P_p$ and driven by the copy machine drive CDM as seen in FIG. 2. The copy paper CP is guided between the feed rolls 120 by a lower guide plate 121 carried at the upstream end of the base side rails 20 as best seen in FIGS. 1–3. The guide plate 121 receives the copy paper CP from the copy machine paper conveyor CPC best seen in FIG. 3 and also mounts a guide roll 122 which rides on the discharge end of the copy machine paper conveyor CPC as seen in FIG. 3 to control the discharge of the copy paper CP onto the guide plate 121. The guide roll 122 is rotatably mounted between a pair of appropriate support links 224 as seen in FIGS. 1 and 3 which are pivotally mounted on the guide plate 121. An upper guide plate 125 is mounted on the top edge of the support links 124 as best seen in FIG. 3 to insure that the copy paper CP is directed toward the nip of the feed rolls 120.

The spacing between the guide plate 110 and the applicator roll assembly 30 is adjusted through spacer screws 115 in positioning tabs 116 on each of the developer side plates 21 and 22 as best seen in FIGS. 1 and 2. The position of the developer side plates 21 and 32 as set by the spacer screws 115 is locked by a pair of lock screws 118 also seen in the FIGS. 1 and 2.

The copy paper CP with the developed electrostatic image LEI thereon discharged over the lip 111 on the guide plate 110 is guided by an upper guide plate 130 best seen in FIG. 3 as mounted on the upstream end of the fuser pillar blocks 24. Lower guide wires 131 wrapped around spaced apart support rods 132 extending between the base side rails 20 below the paper path $P_p$ also help guide the copy paper CP into the fusing section 12.

The guide plate 110 is made out of a ferromagnetic material such as steel. This disrupts the magnetic field from the applicator roll assembly 30 sufficiently to prevent any toner powder particles that may be dislodged from the toner powder layer TPL from being magnetically attracted to the back side of the copy paper CP as it passes through the developing zone DZ. Failure to make the guideplate 110 out of a ferromagnetic material, requires an excess amount of adjustment time to prevent the toner powder particles from being fused onto the back of the copy paper as darkened bands.

As seen in FIGS. 4 and 5, the copy paper CP is directed under the applicator roll 30 by the upper guide surface 112 on the guide plate 110 toward the developing zone DZ. The upward movement of the copy paper CP toward the applicator roll 30 is limited by the underside of the primary doctor blade 54 and the chamferred guide surface 61 thereon. This serves to accurately position the copy paper CP as it passes adjacent the tone powder layer TPL on the applicator roll 30 through the developing zone DZ. The lip 111 on the guide plate 110 serves to deflect the copy paper CP upwardly so as to generate the appropriate wrap of the copy paper CP with respect to the toner powder layer TPL in the developing zone DZ. This insures that the proper amount of toner powder TP will be transferred from the toner powder layer TPL onto the latent electrostatic image LEI due to the electrostatic potential of the layer LEI.

The fusing section 12 includes generally a lower fuser roll 140 rotatably journalled between the base side rails 20 downstream of the developing section 11 about a lower fuser roll axis $A_{LR}$ generally normal to the paper path $P_p$ and an upper fuser roll 141 rotatably journalled between the fuser pillar blocks 24 about an upper fuser roll axis $A_{UR}$ also generally perpendicular to the paper path $P_p$ and above the lower fuser roll 140 as best seen in FIGS. 1–3. It will be noted in FIG. 3 that the axes $A_{LR}$ and $A_{UR}$ are offset a distance $d_{RA}$ to facilitate adjustment of the setting thereof. Each of the fuser rolls 140 and 141 define a cylindrical pressure surface 142 thereon concentric about the respective axes $A_{LR}$ or $A_{UR}$. Also, each of the fuser rolls 140 and 141 are provided with stub shafts 144 at opposite ends thereof received in bearings 145 (FIG. 1) in the base side rails 20 for the lower fuser roll 140 and in the fuser pillar blocks 24 for the upper fuser roll 141. One of the fuser rolls 140 and 141 (here shown as the upper fuser roll 141) is provided with a driving extension 146 on one of the stub shafts 144 which projects rearwardly of the rear fuser pillar block 24 with a drive sprocket 147 to be driven by the copy machine drive CDM as best seen in FIG. 2.

Figure 9:
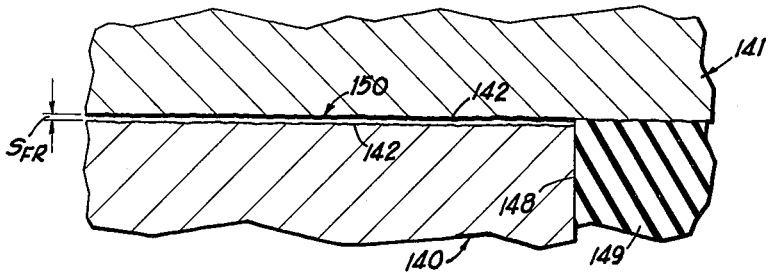
FIG. 9 is a greatly enlarged partial cross-sectional vies taken generally along the line 9—9 in FIG. 3.

The pressure surfaces 142 on the fuser rolls 140 and 141 are not ground smooth as is normally associated with the prior art pressure fuser rolls, but rather, has a rougher finish which is best illustrated in FIG. 9. The finish of the pressure surfaces 142 has a roughness height deviation of about 0.020–0.125 inch and can be achieved by a simple turning operation. On the other hand, prior art fuser rolls had a ground finish with a roughness height deviation usually in the range of 0.002–0.016 inch. The rougher finish of the pressure surfaces 142 prevents the formation of the smooth, highly glossy surface on the copy paper CP as it is passed between the fuser rolls 140 and 141 whereupon the pressure surfaces 142 rupture the toner powder particles TP and force them onto the copy paper CP.

The lower fuser roll 140 is provided with an annular circumferentially extending groove 148 adjacent opposite ends thereof outboard of the effective working area of the pressure surface 142 thereon. Each of the grooves 148 receives an O-ring 149 therein as best seen in FIGS. 2 and 9 so that the pressure surface 142 on the upper fuser roll 141 will ride on the surface of the O-rings 149 projecting above the pressure surface 142 on the lower fuser roll 141.

Figure 10:
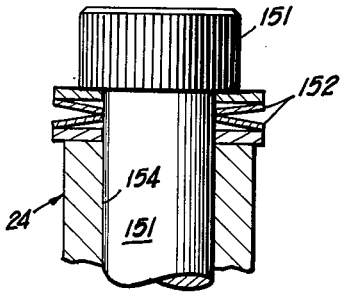
FIG. 10 is an enlarged cross-sectional view taken along generally the line 10—10 in FIG. 3.

Each of the fuser pillar blocks 24 is mounted on fore and aft mounting bolts 151 (FIGS. 1–3 and 10) which are received through appropriate holes 154 (FIG. 10) in the fuser pillar blocks 24 and the base side rails 20 to properly orient the upper fuser roll 141 with the lower fuser roll 140. To supply the necessary force urging the upper fuser roll 141 toward the lower fuser roll 140, springs 152 are positioned between the head of the bolts 151 and the top of the fuser pillar block 24. The particular springs 152 illustrated are Belleville springs of the conical washer type and are able to provide significant loading force with little deflection thereof. As the fore and aft bolts 151 are tightened to deform the springs 152, the upper fuser roll 141 is forced toward the lower fuser roll 140. This causes the pressure surface 142 on the upper fuser roll 141 to ride on the surface of the O-rings 149 as seen in FIG. 9 and deform the O-rings 149 themselves. The O-rings 149 are selected with a sufficient strength to cause the springs 152 to load the fuser roll 141 toward the fuser roll 140 with a fusing force, usually about 250–300 pounds to effectively fuse the toner powder particles onto the copy paper CP as it passes therebetween. The O-rings 149 provide a reactive force urging the pressure surfaces 142 apart in opposition to the forces of springs 152 urging the surfaces 142 together. The O-rings 149 are sized to permit the fuser rolls 140 and 141 to be set with spacing $S_{FR}$ as seen in FIG. 9 less than the thickness of the copy paper CP. As the copy paper CP passes between the nip 150 of the pressure rolls 140 and 141, the load on the O-rings 149 due to springs 152 is transferred to the copy paper CP to provide the fusing force for the toner powder TP thereon. The O-rings 149 still remain in driving contact between the rolls 140 and 141 to insure positive rotation of the lower roll 140 clockwise in FIG. 3 and the upper roll 141 counterclockwise to feed the copy paper CP between the pressure rolls. Usually the spacing $S_{FR}$ is limited to about 0.001 – 0.002 inch (0.025 – 0.051 mm) to insure load transfer to the copy paper CP since the copy paper CP is usually about 0.003 inch (0.076 mm) thick. Since the load between the pressure rolls 140 and 141 is carried by the O-rings 149, the start-up torque required to start the pressure rolls 140 and 141 rotating is sufficiently low to permit the existing copy machine drive CMD to drive same. Also, when the surfaces 142 are not in contact, the feeding of the copy paper CP between rolls 140 and 141 is facilitated. As will be understood, very little deflection is needed between the fuser rolls 140 and 141 to start the feeding of the copy paper CP therebetween, however, the fusing pressure on the fusing paper on the toner powder particles on the copy paper CP is assured to properly fuse the toner powder particles onto the copy paper CP. When the upper fuser roll 141 snaps back toward the lower fuser roll 140, the O-rings 149 prevent the surfaces 142 from striking.

To assist in removing the copy paper CP from the fuser roll in contact with the toner powder particles, here shown as the upper fuser roll 141, a stripper plate 155 is provided on the downstream side of the upper fuser roll 141. To assist in guiding the copy paper CP after it has been fused, a lower guide plate 156 is provided between the base side rail 20 downstream of the fuser rolls 140 and 141. To insure removal of any toner powder particles that offset onto the fuser roll in contact with these particles, here shown as the upper fuser roll 141, a cleaning device 160 is provided which may have a number of different configurations. The configurations shown include a mounting bracket 161 which extends between the fuser pillar block 24 above the upper fuser roll 141 and adjustable mounts thereon a scraper blade 162 made out of a material such as plastic.

While specific embodiments of the invention have been disclosed herein, it is to be understood that full use may be made of modifications, substitutions and equivalents without departing from the scope of the inventive concept.

What is claimed as invention is:

1. Developer apparatus for applying a single component magnetically responsive dry particulate toner powder to a latent electrostatic image on electrostatic copy paper moving along a prescribed paper path comprising:

a support frame;

an applicator roll assembly mounted on said support frame having a roll central axis oriented generally normal to the prescribed paper path; said applicator roll assembly including a cylindrical permanent magnet core concentric about said roll central axis and having circumferentially spaced, alternating polarity, permanent magnet poles on the periphery thereof extending along the length thereof generally parallel to said roll central axis, and a non-magnetic sleeve member concentrically mounted about said permanent magnet core and said roll central axis, said sleeve member having an inside diameter larger than the outside diameter of said permanent magnet core, and said sleeve member and said permanent magnet core rotatable relative to each other about said roll central axis so that said permanent magnet poles move around the inside of and closely adjacent to said sleeve member to generate a magnetic field around the outside of said sleeve member;

a paper guide member mounted on said support frame adjacent a prescribed circumferential developing position on said sleeve member so that the copy paper passes between said sleeve member and said paper guide member as it moves along the prescribed paper path, said paper guide member positioning the copy paper closely adjacent said sleeve member at the developing position as the copy paper passes thereby;

supply means for supplying the toner powder to the periphery of said sleeve member at a prescribed toning position circumferentially shifted with respect to said developing position;

drive means operatively connected to said applicator roll assembly for effecting relative rotation between said permanent magnet core and said sleeve member to cause the toner powder to move around said applicator roll assembly past said developing position;

an electrically non-conductive primary doctor blade mounted on said support frame and defining a primary doctor edge thereon, said doctor edge oriented generally normal to the paper path and closely adjacent the periphery of said sleeve member so that the toner powder being magnetically moved around said applicator roll assembly passes between said primary doctor edge and said sleeve member to control the amount of the toner powder passing thereby, said primary doctor edge further located closely adjacent said developing position to accurately control the amount of toner powder exposed to the latent electrostatic image on said copy paper at said developing position for transfer from said sleeve member to the latent electrostatic image on the copy paper; and, a secondary doctor blade mounted on said support frame and defining a secondary doctor edge thereon, said secondary doctor edge oriented generally normal to the paper path and closely adjacent the periphery of said sleeve member so that the toner powder passes between said secondary doctor edge and said sleeve member as the toner powder passes around said applicator roll assembly from the toning position to the developing position so that the amount of toner powder passing from the toning position to the primary doctor blade is regulated.

2. Developer apparatus for applying a single component magnetically responsive dry particulate toner powder to a latent electrostatic image on electrostatic copy paper moving along a prescribed paper path comprising:

a support frame;

an applicator roll assembly mounted on said support frame having a roll central axis oriented generally normal to the prescribed paper path; said applicator roll assembly including a cylindrical permanent magnet core concentric about said roll central axis and having circumferentially spaced, alternating polarity, permanent magnet poles on the periphery thereof extending along the length thereof generally parallal to said roll central axis, and a non-magnetic sleeve member concentrically mounted about said permanent magnet core and said roll central axis, said sleeve member having an inside diameter larger than the outside diameter of said permanent magnet core, and said sleeve member and said permanent magnet core rotatable relative to each other about said roll central axis so that said permanent magnet poles move around the inside of and closely adjacent to said sleeve member to generate a magnetic field around the outside of said sleeve member;

a paper guide member mounted on said support frame adjacent a prescribed circumferential developing position on said sleeve member so that the copy paper passes between said sleeve member and said paper guide member as it moves along the prescribed paper path, said paper guide member positioning the copy paper closely adjacent said sleeve member at the developing position as the copy paper passes thereby;

supply means for supplying the toner powder to the periphery of said sleeve member at a prescribed toning position circumferentially shifted with respect to said developing position, said supply means including a cartridge assembly containing a supply of the toner powder, said cartridge assembly defining a discharge opening therein from which the toner powder falls by gravity, said discharge opening generally vertically aligned with the toning position on said applicator roll assembly so that the toner powder falling from said discharge opening in said cartridge assembly falls by gravity toward the toning position; and a secondary doctor blade mounted on said support frame at the toning position so that the falling toner powder is caught between said secondary doctor blade and said sleeve member, said secondary doctor blade defining a secondary doctor edge thereon, oriented generally normal to the paper path and closely adjacent the periphery of said sleeve member so that the toner powder caught between said secondary doctor blade and said sleeve member passes between said secondary doctor edge and said sleeve member as the toner powder passes around said applicator roll assembly from the toning position to the developing position so that the amount of toner powder passing from the toning position to the primary doctor blade is regulated;

drive means operatively connected to said applicator roll assembly for effecting relative rotation between said permanent magnet core and said sleeve member to cause the toner powder to move around said applicator roll assembly past said developing position; and, an electrically non-conductive primary doctor blade mounted on said support frame and defining a primary doctor edge thereon, said doctor edge oriented generally normal to the paper path and closely adjacent the periphery of said sleeve member so that the toner powder being magnetically moved around said applicator roll assembly passes between said primary doctor edge and said sleeve member to control the amount of the toner powder passing thereby, said primary doctor edge further located closely adjacent said developing position to accurately control the amount of toner powder exposed to the latent electrostatic image on said copy paper at said developing position for transfer from said sleeve member to the latent electrostatic image on the copy paper.

3. The developer apparatus of claim 2 wherein said cartridge assembly includes regulating means for selectively varying the effective size of said discharge opening.

4. The developer apparatus of claim 3 wherein said cartridge assembly includes:

an inner tube carrying the toner powder therein and defining an inner elongate slot therethrough;

an outer tube rotatably mounted about said inner tube and defining an outer elongate slot therein selectively registerable with said inner slot in said inner tube as said outer tube is rotated with respect to said inner tube;

locking means locating said inner tube with respect to said support frame so that said inner slot faces said toning position on said applicator roll assembly, said inner and outer slots forming said discharge opening from said cartridge assembly; and, control means for selectively rotating said outer tube with respect to said inner tube to bring said outer slot into registration with said inner slot.

5. The developer apparatus of claim 1 wherein said primary doctor edge is located about 0.010 – 0.030 inch from said sleeve member.

6. The developer apparatus of claim 5 wherein said primary doctor blade is oriented tangential to the surface of said sleeve member at said primary doctor edge.

7. The developer apparatus of claim 1 wherein said paper guide member is magnetically conductive to prevent toner attraction to that side of the copy paper opposite the applicator roll assembly as the copy paper passes through the developing position.

8. The developer apparatus of claim 7 wherein said paper guide member defines a substantially flat guide surface thereon facing said sleeve member, said guide surface generally tangent to said sleeve member at said developing position and spaced from said sleeve member a minimum distance of about 0.020 – 0.060 inch.

9. The developer apparatus of claim 1 wherein said secondary doctor edge is located about 0.015 – 0.040 inch from said sleeve member.

10. The developer apparatus of claim 9 wherein said secondary doctor blade is located generally radial to the surface of said sleeve member at said secondary doctor edge.

11. Developer apparatus for applying a single component magnetically responsive dry particulate toner powder to a latent electrostatic image on electrostatic copy paper moving along a prescribed paper path comprising:

a support frame;

an applicator roll assembly mounted on said support frame having a roll central axis oriented generally normal to the prescribed paper path; said applicator roll assembly including a cylindrical permanent magnet core concentric about said roll central axis and having circumferentially spaced, alternating polarity, permanent magnet poles on the periphery thereof extending along the length thereof generally parallel to said roll central axis, and a non-magnetic sleeve member concentrically mounted about said permanent magnet core and said roll central axis, said sleeve member having an inside diameter larger than the outside diameter of said permanent magnet core, and said sleeve member and said permanent magnet core rotatable relative to each other about said roll central axis so that said permanent magnet poles move around the inside of and closely adjacent to said sleeve member to generate a magnetic field around the outside of said sleeve member;

a paper guide member mounted on said support frame adjacent a prescribed circumferential developing position on said sleeve member so that the copy paper passes between said sleeve member and said paper guide member positioning the copy paper closely adjacent said sleeve member at the developing position as the copy paper passes thereby, said paper guide member magnetically conductive to prevent toner attraction to that side of the copy paper opposite the applicator roll assembly as the copy paper passes through the developing position, and said paper guide member including a guide lip thereon at the downstream end of said developing position to deflect the copy paper toward said sleeve member and wrap the copy paper closely adjacent said sleeve member as the copy paper passes through the developing position;

supply means for supplying the toner powder to the periphery of said sleeve member at a prescribed toning position circumferentially shifted with respect to said developing position;

drive means operatively connected to said applicator roll assembly for effecting relative rotation between said permanent magnet core and said sleeve member to cause the toner powder to move around said applicator roll assembly past said developing position; and, an electrically non-conductive primary doctor blade mounted on said support frame and defining a primary doctor edge thereon, said doctor edge oriented generally normal to the paper path and closely adjacent the periphery of said sleeve member so that the toner powder being magnetically moved around said applicator roll assembly passes between said primary doctor edge and said sleeve member to control the amount of the toner powder passing thereby, said primary doctor edge further located closely adjacent said developing position to accurately control the amount of toner powder exposed to the latent electrostatic image on said copy paper at said developing position for transfer from said sleeve member to the latent electrostatic image on the copy paper.

12. Developer apparatus for applying a single component magnetically responsive dry particulate toner powder to a latent electrostatic image on electrostatic copy paper moving along a prescribed paper path comprising:

a support frame;

an applicator roll assembly mounted on said support frame having a roll central axis oriented generally normal to the prescribed paper path; said applicator roll assembly including a cylindrical permanent magnet core concentric about said roll central axis and having circumferentially spaced, alternating polarity, permanent magnet poles on the periphery thereof extending along the length thereof generally parallel to said roll central axis, and a non-magnetic sleeve member concentrically mounted about said permanent magnet core and said roll central axis, said sleeve member having an inside diameter larger than the outside diameter of said permanent magnet core, and said sleeve member and said permanent magnet core rotatable relative to each other about said roll central axis so that said permanent magnet poles move around the inside of and closely adjacent to said sleeve member to generate a magnetic field around the outside of said sleeve member;

a paper guide member mounted on said support frame adjacent a prescribed circumferential developing position on said sleeve member so that the copy paper passes between said sleeve member and said paper guide member as it moves along the prescribed paper path, said paper guide member positioning the copy paper closely adjacent said sleeve member at the developing position as the copy paper passes thereby;

supply means for supplying the toner powder to the periphery of said sleeve member at a prescribed toning position circumferentially shifted with respect to said developing position;

drive means operatively connected to said applicator roll assembly for effecting relative rotation between said permanent magnet core and said sleeve member to cause the toner powder to move around said applicator roll assembly past said developing position; and, an electrically non-conductive primary doctor blade mounted on said support frame and defining a primary doctor edge thereon, said doctor edge oriented generally normal to the paper path and closely adjacent the periphery of said sleeve member so that the toner powder being magnetically moved around said applicator roll assembly passes between said primary doctor edge and said sleeve member to control the amount of the toner powder passing thereby, said primary doctor edge further located closely adjacent said developing position to accurately control the amount of toner powder exposed to the latent electrostatic image on said copy paper at said developing position for transfer from said sleeve member to the latent electrostatic image on the copy paper, said primary doctor blade defining a chamferred paper guide surface thereon adjacent said primary doctor edge, said chamferred paper guide surface facing said paper guide member and cooperating with said paper guide member to guide the copy paper into the developing position.

13. Developer apparatus for applying a single component magnetically responsive dry particulate toner powder to a latent electrostatic image on electrostatic copy paper moving along a prescribed paper path comprising:

a support frame;

an applicator roll assembly mounted on said support frame having a roll central axis oriented generally normal to the prescribed paper path; said applicator roll assembly including a cylindrical permanent magnet core concentric about said roll central axis and having circumferentially spaced, alternating polarity, permanent magnet poles on the periphery thereof extending along the length thereof generally parallel to said roll central axis, and a non-magnetic sleeve member concentrically mounted about said permanent magnet core and said roll central axis, said sleeve member having an inside diameter larger than the outside diameter of said permanent magnet core, and said sleeve member and said permanent magnet core rotatable relative to each other about said roll central axis so that said permanent magnet poles move around the inside of and closely adjacent to said sleeve member to generate a magnetic field around the outside of said sleeve member;

a paper guide member mounted on said support frame adjacent a prescribed circumferential developing position on said sleeve member so that the copy paper passes between said sleeve member and said paper guide member as it moves along the prescribed paper path, said paper guide member positioning the copy paper closely adjacent said sleeve member at the developing position as the copy paper passes thereby;

supply means for supplying the toner powder to the periphery of said sleeve member at a prescribed toning position circumferentially shifted with respect to said developing position;

drive means operatively connected to said applicator roll assembly for effecting relative rotation between said permanent magnet core and said sleeve member to cause the toner powder to move around said applicator roll assembly past said developing position;

an electrically non-conductive primary doctor blade mounted on said support frame and defining a primary doctor edge thereon, said doctor edge oriented generally normal to the paper path and closely adjacent the periphery of said sleeve member so that the toner powder being magnetically moved around said applicator roll assembly passes between said primary doctor edge and said sleeve member to control the amount of the toner powder passing thereby, said primary doctor edge further located closely adjacent said developing position to accurately control the amount of toner powder exposed to the latent electrostatic image on said copy paper at said developing position for transfer from said sleeve member to the latent electrostatic image on the copy paper; and fusing means for fixing the toner powder applied to the latent electrostatic image on the copy paper using pressure, said fuser means including:

a first fuser roll rotatably mounted in said support frame about a first roll axis and defining a first cylindrical pressure surface thereon concentric about said first roll axis.

a second fuser roll rotatably mounted in said support frame about a second roll axis generally parallel to said first roll axis and defining a second cylindrical pressure surface thereon concentric about said second roll axis;

first forcing means for urging said first and second fuser rolls toward each other to form a nip between said pressure surfaces, said first forcing means including Belleville washer springs operatively connecting said first and second fuser rolls; and second forcing means for resiliently limiting the movement of said fuser rolls toward each other in opposition to said first means so that when the copy paper with the toner powder particles passes through the nip between said pressure surfaces, the pressure surfaces on said fuser rolls apply sufficient pressure to said toner powder particles to fuse same onto the copy paper.

14. The developing apparatus of claim 13 wherein said second forcing means of said fuser means includes a pair of elastomer O-rings operatively connecting said first and second fuser rolls at opposite ends thereof.

15. The developing apparatus of claim 13 wherein said first and second pressure surfaces on said pressure rolls of said fuser means have a surface finish roughness height deviation of about 0.020 – 0.0125 inch.

* * * * *